United States Patent [19]

Feller

[11] Patent Number: 4,948,965

[45] Date of Patent: Aug. 14, 1990

[54] CONDUCTIVELY COOLED MICROCHANNEL PLATES

[75] Inventor: Winthrop B. Feller, Sturbridge, Mass.

[73] Assignee: Galileo Electro-Optics Corporation, Sturbridge, Mass.

[21] Appl. No.: 309,195

[22] Filed: Feb. 13, 1989

[51] Int. Cl.[5] ..... H01J 40/14

[52] U.S. Cl. ..... 250/207; 313/103 CM

[58] Field of Search ..... 250/207; 313/103 CM, 313/105 CM, 534, 535

[56] References Cited

U.S. PATENT DOCUMENTS

| | | | |
|---|---|---|---|
| 2,932,768 | 4/1960 | Wiley | 315/39.63 |
| 3,187,226 | 6/1965 | Kates | 317/100 |
| 3,227,905 | 1/1966 | Talcott | 313/39 |
| 3,243,628 | 3/1966 | Matheson | 313/103 |
| 3,244,922 | 4/1966 | Wolfgang | 313/95 |
| 3,675,063 | 7/1972 | Spindt et al. | 313/104 |
| 3,825,922 | 7/1974 | Ralph | 313/103 CM |
| 4,021,216 | 5/1977 | Asam et al. | 65/413 |
| 4,095,132 | 6/1978 | Fraioli | 313/103 CM |
| 4,126,804 | 11/1978 | Asam et al. | 313/105 CM |
| 4,365,150 | 12/1982 | Bateman | 250/207 |
| 4,529,912 | 7/1985 | Northrup et al. | 315/117 |
| 4,555,731 | 11/1985 | Zinchuk | 358/209 |
| 4,567,505 | 1/1986 | Pease et al. | 357/81 |
| 4,672,193 | 6/1987 | Duchenois | 313/105 CM |
| 4,714,861 | 12/1987 | Tosswill | 315/117 |
| 4,730,141 | 3/1988 | Tosswill | 313/366 |

OTHER PUBLICATIONS

Channel Electron Multipliers by Edward A. Kurz, reprinted from American Laboratory, Mar. 1979.

Curved-Channel Microchannel Array Plates by J. Gethyn Timothy Rev. Sci. Instrum, vol. 52, No. 8, Aug. 1981.

Preliminary Results with Microchannel Array Plates Employing Curved Microchannels to Inhibit Ion Feedback, by J. G. Timothy and R. L. Bybee, Rev. Sci. Instrum, vol. 48, No. 3, Mar. 1977.

Matsuura et al., Current Status of the Micro Channel Plate, IEEE Trans. Nucl. Sci. NS-31 (1984).

Armentrout, Large-Area, Triple-Layer, Microchannel-Plate Arrays, Rev. Sci. Instr. 56 (Jun. 1985) p. 1179.

*Primary Examiner*—David C. Nelms
*Assistant Examiner*—Sherrie Hsia
*Attorney, Agent, or Firm*—John P. DeLuca

[57] ABSTRACT

A conductively cooled microchannel plate is disclosed. Cooling is achieved by placing an active face of the MCP in thermal contact with a thermally conductive substrate for dissipating joule heating.

38 Claims, 5 Drawing Sheets

CONDUCTIVELY COOLED MICROCHANNEL PLATES

GOVERNMENT RIGHTS

This invention was made with Government support under Contract No. NAS1-18482 awarded by NASA. The Government has certain rights in this invention.

BACKGROUND OF THE INVENTION

This invention relates to microchannel plate (MCP) electron multipliers. In particular, the invention relates to conductively cooled MCPs which can be continuously operated at relatively high power levels without thermal runaway.

A channel electron multiplier 10 (FIG. 1) of the prior art is a device which detects and amplifies electromagnetic radiation. A secondary electron emitting semiconductor layer 12, which gives up one or more secondary electrons 14 in response to bombardment by primary radiation 16, for example, photons, electrons, ions or neutral species, is formed on the inner surface of the glass channel wall 18 during manufacture. Thin film metal electrodes 20 are deposited on opposite ends of the channel 18. A bias voltage 22 is imposed across the channel 18 to accelerate the secondary electrons 14 which are created by the incident radiation 16 at the input end of the channel. These electrons are accelerated along the channel until they strike the wall again, creating more secondary electrons. The avalanching process continues down the channel, producing a large cascade of output electrons 24 at the channel output.

A microchannel plate or MCP 30 (FIG. 2) of the prior art is an electron multiplier array of microscopic channel electron multipliers. The MCP likewise directly detects and amplifies electromagnetic radiation and charged particles. Currently a typical MCP is manufactured from a glass wafer 32 having a honeycomb structure of millions of identical microscopic channels 34, with a channel diameter which can be as small as a few microns. Each channel is essentially independent of adjacent channels, and is capable of functioning as a single channel electron multiplier. The channels 34 are coated with a semiconductor material 36. Active or respective input and output faces 38 and 40 of the MCP 32 are formed by corresponding apertured bias electrodes 42 and 44 which may be deposited by vapor deposition or sputtering techniques onto the wafer 32. The anode collector 50 is secured in confronting spaced relationship with respect to the output face 40 of the MCP 30 for collecting the electron output charge cloud or output 52. Typically, mounting apparatus 56 secures the microchannel plate 32 and the anode 50 in a vacuum chamber 54, and provides electrical connections 56 to the bias electrodes 42 and 44. After leaving the channel 34, the amplified charge cloud 52 is collected by one or more metal anodes 50 to produce an electrical output signal, or else impinges on a phosphor screen (not shown) to produce a visible image. By appropriate biasing of the electrodes 42 and 44 and the anode 50 the charged particles are driven from the MCP output to the anode across gap 62.

In general, the anodes or the phosphor screen are always separated from the output face 40 of the MCP 30. More sophisticated electrical readout configurations than simple anode pads include multi-wire readouts, multi-anode microchannel array (MAMA) coincidence readouts, CODACON, wedge and strip, delay line, or the resistive anode encoder. Although a direct contact anode has been mentioned in the literature, most conventional devices, including the aforementioned arrangements, require physical separation (i.e., gap 62) of the anode from the MCP output face.

Thermal radiation 60 emanating from the input face 38 as well as the output face 40 of the MCP 30 is the predominant and primary mechanism for transport of heat from the device 30. A small portion of the MCP heat 60' is conducted laterally through the MCP 30 to the metal mounting apparatus 56. According to the prior art, typical maximum heat dissipation of an arrangement such as is illustrated in FIG. 2 is limited to about 0.1 watt/cm$^2$ of MCP active area as further discussed below.

As a sizeable electron cascade develops towards the end of the channel, secondary electrons lost from the channel wall leave behind a positive wall charge, which must be neutralized before another electron cascade can be generated. This is accomplished by the bias current flowing down the channel from the bias voltage supply (not shown), which also establishes the axial channel electric field. Neutralization must occur at a rate faster than the input event rate if multiplier efficiency is to be maintained, or else the multiplier gain will rapidly deteriorate and subsequent input events will not be sufficiently amplified. In effect, the channel is paralyzed, resulting in a channel dead time, the time required to neutralize the positive wall charge before the gain process can be reestablished.

Increasing the MCP bias current decreases the channel dead time, hence it is desirable that the resistivity of the channel wall material be as low as possible while still maintaining its role as a potential divider. However, the semiconducting material on the channel wall exhibits a negative temperature coefficient of resistance (i.e, as temperature increases, resistance decreases.) Resistive (or joule) heating is caused by the flow of bias current. If this is not dissipated quickly enough from the MCP active area, it will lower the MCP resistance, resulting in increased bias current, which in turn will result in additional joule heating. (Use of voltage- or current-controlled power supplies cannot prevent this without changes to MCP gain.) Therefore if the initial MCP resistance is too low, thermal equilibrium will never be reached at operating voltages, and a critical temperature will soon be exceeded so that thermal runaway occurs and the MCP is destroyed.

In conventional MCP mounting configurations (FIG. 2) where the active areas of both MCP faces 40 and 42 are open to the vacuum, practically all the joule heat must be dissipated radiatively from the faces, since there can only be negligible conduction through the rim 63 to the mounting apparatus 56 due to the low thermal conductivity of glass. This inefficient heat removal process prevents thermal equilibrium from being reached at power levels greater than roughly 0.1 watt/cm$^2$, which can be shown using the Stefan-Boltzmann law and appropriate values for MCP thermal emissivity. This corresponds to a maximum MCP bias current of about 100 microamps/cm$^2$ at 1000 V, or a single channel resistance of roughly $10^{12}$ ohms.

This upper limit to MCP bias current will place a limit on the channel recharge time, limiting the MCP count rate capability or frequency response and thus dynamic range. For an output electron cascade of at least several times $10^5$ electrons, required for pulse-counting, the channel recharge time will be at least several milliseconds. If the count rate per channel exceeds about 100 Hz, the channel will be unable to recharge sufficiently, with a consequent degradation in gain and loss of multiplier efficiency. Assuming a channel packing density on the order of $10^6/cm^2$ and Poisson counting statistics, this places an upper limit to the overall MCP output count rate capability of roughly $10^8$ cts/$cm^2$/sec.

For an increasing number of applications, it is desirable to maintain pulse-counting gain beyond this upper limit, well into the gigahertz frequency region. This can only be achieved by increasing the bias current to a level where channel recharge times are on the order of several microseconds. However, this is obviously impossible using current MCP mounting configurations, where the primary means of heat removal must be through radiation.

In some applications a photocathode (not shown) is closely spaced in front of the MCP 30 to convert incoming visible and UV radiation into photoelectrons, which then act as the primary source of input radiation to the MCP. Photocathodes are quite heat sensitive and produce electrons spontaneously by thermionic emission. As the temperature of the MCP increases, the radiated heat is absorbed by the photocathode causing increasing amounts of spurious electron emission which are then amplified by the MCP, thereby resulting in noise at the output. This heat induced detector noise is undesirable.

SUMMARY OF THE INVENTION

In accordance with this invention, MCP joule heat is removed through conduction, so that the propensity of the MCP to exhibit thermal runaway is greatly reduced and stable MCP thermal behavior is attained. More specifically, the invention comprises an MCP in which a thermally conductive substrate is bonded in intimate thermal contact with at least one face of the MCP for the purpose of dissipating joule heat. The substrate can be either actively or passively cooled. The MCP can be fabricated either from glass or from any other suitable material. In one embodiment of the invention, the substrate may be an electical conductor bonded directly to the output face of the MCP, forming a direct contact anode which also serves as the bias electrode. In another arrangement, the substrate may be a thermally conductive electrical insulator. In such case a metallized surface of the substrate may act as a direct contact anode and bias electrode. Moreover, this metallized surface can take the form of a plurality of discrete electrically isolated anode areas which also serve as bias electrodes. In another embodiment, an electrically insulating perforated layer may be disposed between the MCP and the anode to isolate the anode from the bias voltage, and, in the case of an electrically insulating substrate, to permit segmentation of the anode into an array of discrete charge collecting areas. In yet another embodiment of the invention, a thermally conductive grid is disposed on the input surface of the MCP to provide a conduction mechanism for heat dissipation.

Other advantages of the invention are set forth in the accompanying specification, drawings and claims and are considered within the scope of the invention.

DESCRIPTION OF THE INVENTION

Figure 1:
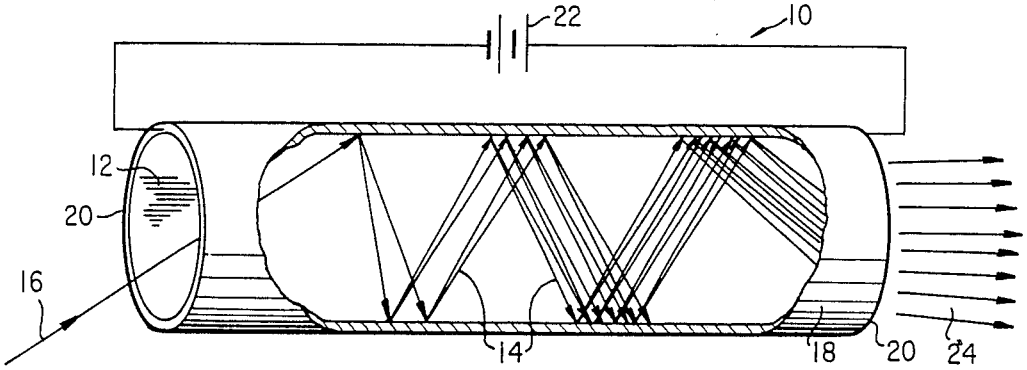
FIG. 1 PRIOR ART
FIG. 1 is a schematic representation of a channel electron multiplier (CEM) of the prior art.
Figure 2:
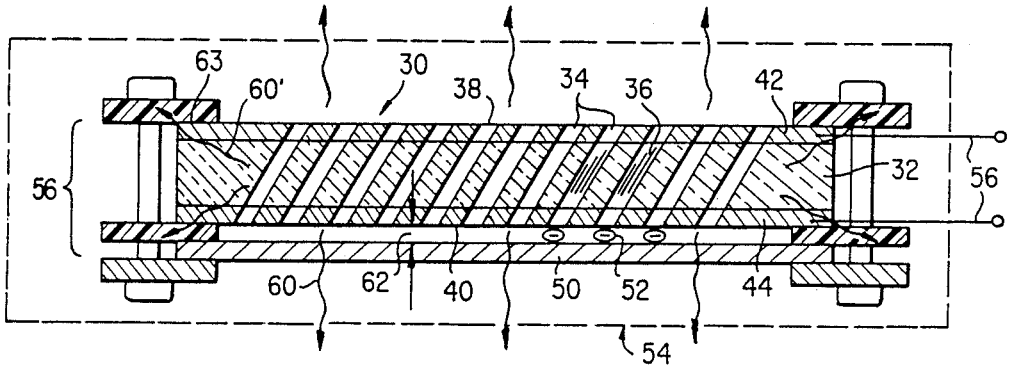
FIG. 2 PRIOR ART
FIG. 2 is a side sectional elevation of a device employing a microchannel plate according to the prior art.
Figure 3:
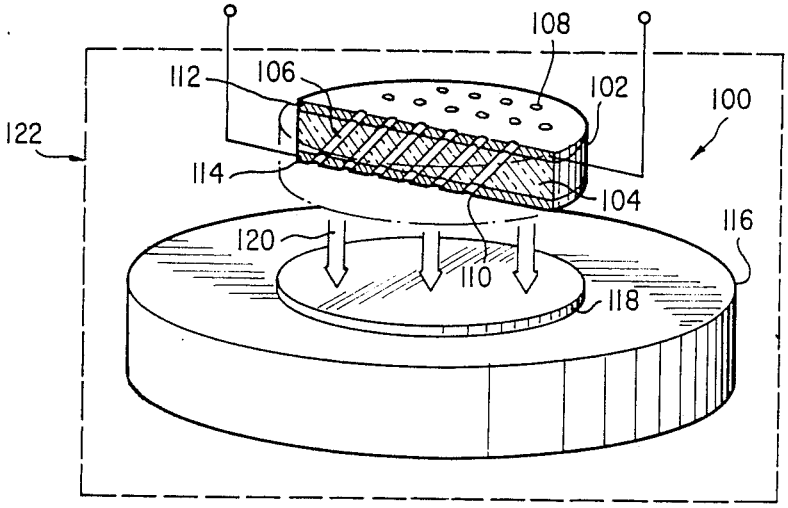
FIG. 3 is an exploded perspective view of the conductively cooled microchannel plate of the present invention.

A device 100 employing a conductively cooled microchannel plate 102 according to the present invention as illustrated in FIG. 3 in an exploded perspective view. Like the arrangement described in FIG. 2, the MCP 102 of the present invention is formed of an apertured wafer 104. It can be fabricated from glass or any other suitable material. The channels 106 extend between the respective active input and output faces 108 and 110. The wafer 104 has apertured bias electrodes 112 and 114 on the corresponding input and output faces 108 and 110 as shown. The MCP 102 is bonded at its active output face !10 to a thermally conductive substrate 116 by means of a bonding layer 118. In one embodiment of the invention, the bonding layer 118 is an indium solder which bonds the wafer 104 via the output bias electrode 114 to the substrate 116. The bias electrode 114 together with the bonding layer 118 may thus be utilized as a direct contact anode for the microchannel plate 102.

In the present invention, the predominant mechanism for heat transfer is conduction to the substrate 116. The heat 120 is absorbed by the substrate 116 to thereby cool the MCP 102. In the embodiment illustrated, the substrate 116 is a copper disk having sufficient mass (e.g., several lbs.) and high thermal conductivity to allow the MCP 102 to operate at power levels of 2 watts/$cm^2$ or greater for about thirty minutes before the onset of thermal runaway without further cooling. In a preferred embodiment where the device 100 is enclosed within an evacuated chamber 122, the heat 120 absorbed by the substrate 116 may be conducted away from the substrate 116 and external of the chamber 122 by means not shown in FIG. 3, but which is described hereafter.

Figure 4:
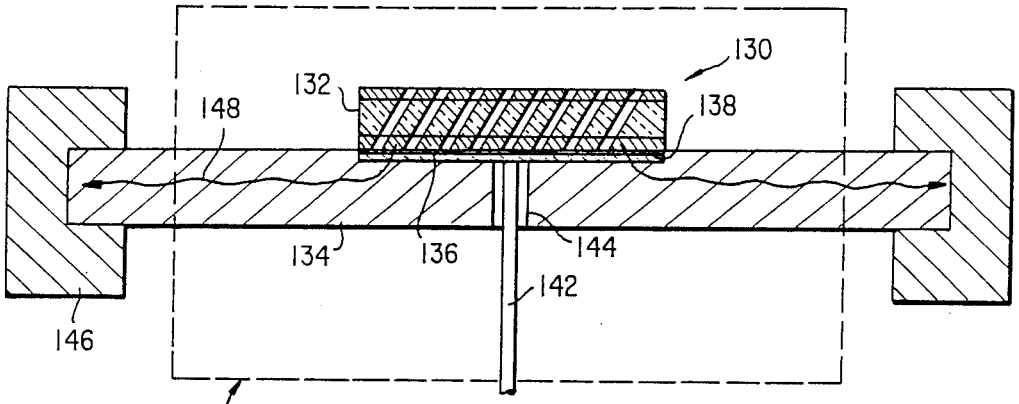
FIG. 4 is a side sectional elevation of a device employing a conductively cooled microchannel plate according to the invention and including an auxiliary external heat sink.

FIG. 4 illustrates another embodiment of the present invention in side sectional elevation. As illustrated, the device 130 includes a microchannel plate 132 having a construction similar to the arrangement of FIG. 3. In this arrangement, however, the substrate 134 is a thermally conductive electrical insulator and carries a suitably bonded metal anode 136 on its surface. The MCP 132 is bonded to the anode 136 and thus to the substrate 134 by means of bonding layer 138 in a manner similar to the arrangement described with respect to FIG. 3. In a preferred embodiment the MCP 132 is enclosed within an evacuated chamber 140. The anode lead 142 carries the output electron signal produced by the MCP and the bias current through the via or plated aperture 144 in the substrate 134 to circuitry (not shown) external of the chamber 140. The anode 136 and the anode lead 142 may be electrically insulated if the substrate 134 is an electrical conductor. Otherwise it may remain uninsulated as shown. A heat sink 146 which may be partially or fully external to the chamber 140, as shown, is attached to the periphery of the substrate 134 for removing heat 148 from the MCP 132 via the substrate 134. The heat sink 146 gives up heat to ambient external to the chamber 140 by any appropriate heat exchange mechanism, including convection, conduction and/or radiation.

Figure 5:
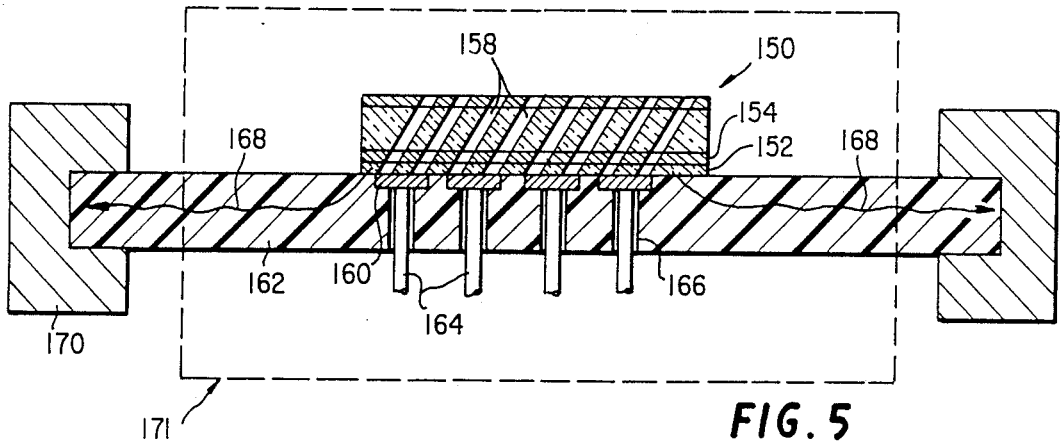
FIG. 5 is a side sectional elevation of a device according to another embodiment of the present invention employing an electrically insulating layer between the MCP and a multi-anode.

FIG. 5 is another embodiment of the present invention in which the bias and output charge collecting functions of the device 150 are electrically separated by means of a modified bonding layer comprising a layer of sputtered material 152 (e.g. glass) bonded to the bias electrode 154. The layer 152 has apertures in registration with the microchannels 158 as shown. One or more anodes 160 are bonded to the layer 152 by solder for example. The anodes 160 are suitably bonded to the substrate 162, an electrical insulator. The anode leads 164 carry output signal or current through the vias 166 in the substrate 162, whereas bias electrode 154 carries the bias current. The layer 152 insulates the bias electrode 154 from the anode 160 and thus electrically separates bias and charge collection functions. The anodes 160 and anode leads 164 may be electrically insulated if the substrate 162 is an electrical conductor. Heat 168 produced by the device 150 is transported by conduction to auxiliary peripheral heat sink 170 which may be external of chamber 171.

Figure 6:
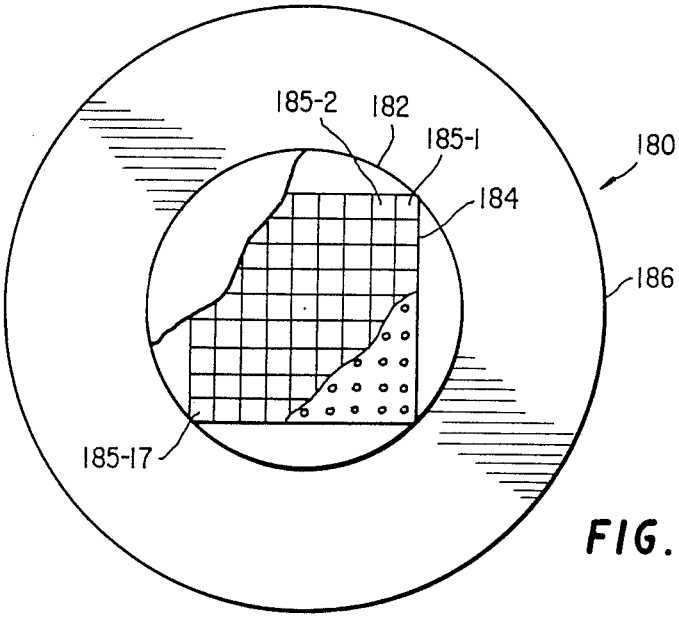
FIG. 6 is a fragmentary top plan view of a device according to another embodiment of the present invention employing multiple anodes.

FIG. 6 is a fragmented top plan view of a device 180 employing a conductively cooled MCP 182 according to the present invention in which a direct contact multi-element anode 184, including anode areas 185-1, 185-2 185-N is attached to the substrate 186, an electrical insulator, and forms part of the bonding layer between the MCP 182 and the substrate 186.

Figure 7:
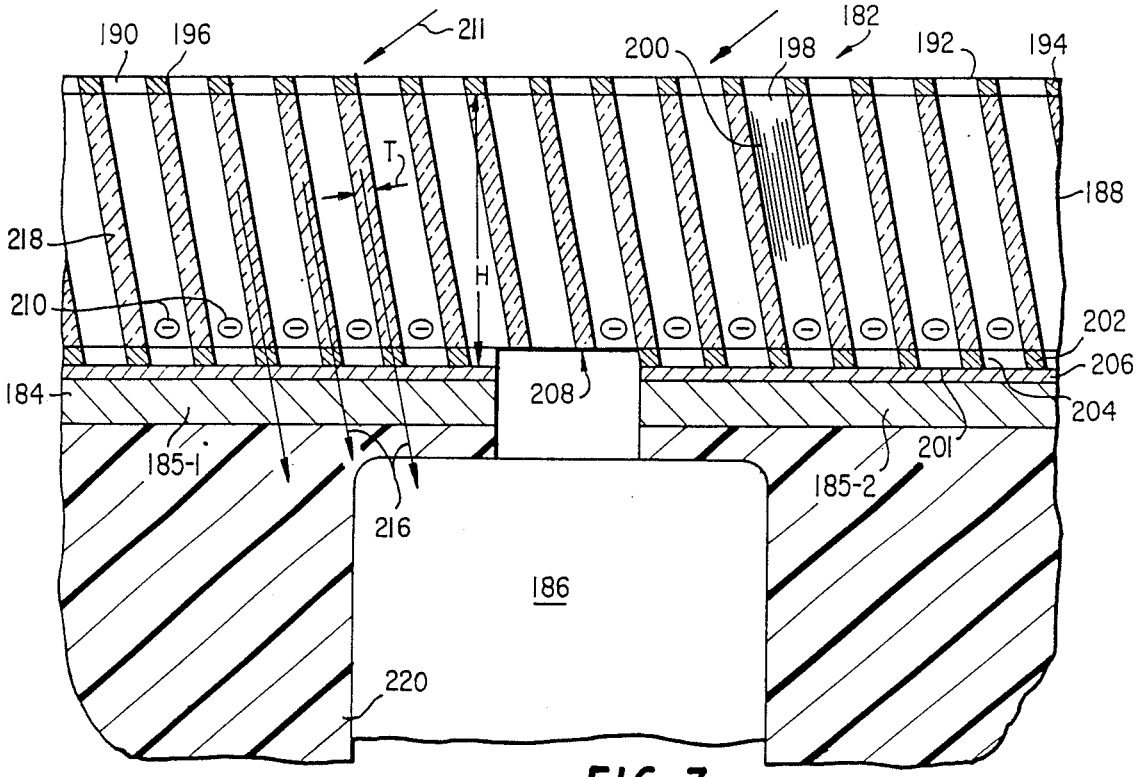
FIG. 7 is a fragmented side sectional elevation of the device shown in FIG. 6.

FIG. 7 is an enlarged fragmentary detail of FIG. 6 in side sectional elevation. The MCP 182 is similar to the arrangements hereinbefore described and includes a wafer 188 having channels 190 therein. The MCP 182 has an input surface 192 formed with an apertured bias electrode 194 deposited on the wafer 188. Apertures 196 in the bias electrode 194 are in registration with the channels 190. The walls 198 of the channels 190 are coated with semiconductor material 200. Output surface 201 of the wafer 188 has apertured and segmented bias electrode 202 deposited thereon. Apertures 204 in the bias electrode 202 are in registration with the channels 190. The bias electrode 202 is segmented, as illustrated by discontinuity 208, in registration with the corresponding segments 185-1 ... 185-n of multi-element anode (FIG. 6). A bonding layer 206, which may be a layer of solder alloy, connects the bias electrode 202 with the multi-element anode 184 as shown.

Charge 210 produced in the MCP 182 is collected in each segment 185-1 185-n of the anode 184 in accordance with the spatial distribution of radiation 211 falling on the input surface 192 of the MCP 182. If the radiation 211 is not distributed uniformly across the MCP 182, the output charge 210 is likewise nonuniform and thus each segment 185-1 ... 185-n of the anode 184 receives an output charge in proportion to the distribution of the radiation 211. Accordingly, the multi-element anode 184 allows for increased resolution and an enhanced range of applications.

The bias electrode 202 may be segmented to have a discontinuity in registration with the anode discontinuity 208 by masking the wafer 188 prior to deposition of the electrode material thereon. Alternately, segmentation of the electrode 202 may be accomplished by other known techniques. The anode 184 may likewise be segmented by similar methods. The bonding layer 206 may be an indium solder which has a surface tension when melted sufficient to preferably wet the anode 184 and the electrode 202 and not bridge the discontinuity 208 between the individual segments 185-1 185-n or in the bias electrode 202. Thus, according to one embodiment of the present invention, a direct contact multielement anode has been provided for a conductively cooled MCP.

The conductive heat transport mechanism of the present invention is also shown in greater detail in FIG. 7. Joule heating resulting from current flow in the semiconducting layer 200 generates heat 216 in the MCP 182. The heat 216 is conducted by the channel walls 218 to the substrate 186 via intermediate layers such as the bias electrode 202, the bonding layer 206, and the anode 184. The channel walls 218 have a relatively narrow thickness T compared with the height H of the MCP 182. Nevertheless, transfer of the heat 216 through the channel walls 218 to the substrate 186 is sufficiently efficient such that energy dissipation in excess of 10 watts in 40:1 L/D MCPs having 10 micron channel diameters has been achieved without thermal runaway.

Figure 8:
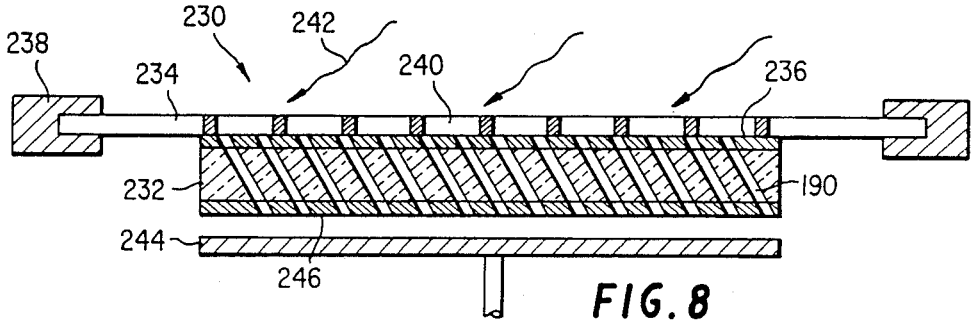
FIG. 8 is a side sectional elevation of another embodiment of the present invention employing a front surface heat conductive substrate grid.

FIG. 8 illustrates a device 230 employing a conductively cooled MCP 232 in accordance with another embodiment of the present invention in which a thermally conductive grid 234 is deposited atop the input face 236 of the MCP 232. In the arrangement of FIG. 8 the peripheral heat sink 238 is in thermal contact with the grid 234. In accordance with the invention, the grid 234 is sufficiently conductive of thermal energy to carry energy away from the MCP 232 to the heat sink 238. Apertures 240 in the grid 234 admit radiation 242 to the input face 236 of the MCP 232. In the arrangement illustrated in FIG. 8, the anode collector 244 may be spaced from the output face 246 of the MCP 232. Such an arrangement is possible because heat is carried away and dissipated by the substrate at the input face 236.

Figure 9:
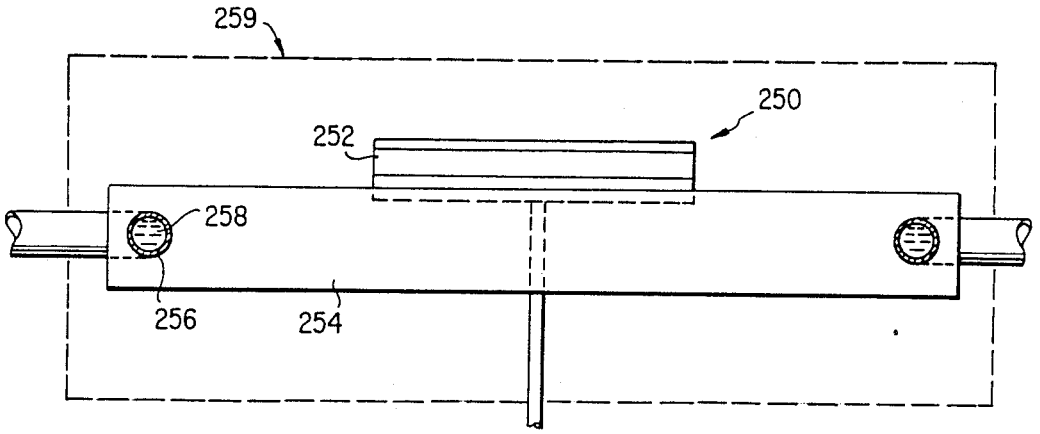
FIG. 9 is a side sectional elevation of an embodiment of the invention employing internal substrate cooling.

FIG. 9 is an example of a device 250 according to another embodiment of the invention having a conductively cooled MCP 252 which is mounted in heat exchange relationship with an actively cooled substrate 254. In the arrangement, a cooling line 256 is embedded in the substrate 254. The cooling line 256 carries a working fluid 258 such as water into and out of the substrate 256 through the vacuum chamber 259. In a similar manner, although not shown, any of the substrates hereinbefore described may be actively cooled as illustrated. In addition, any of the heat sinks hereinbefore described may be enclosed in the chamber 259 and may be provided with a cooling line such as illustrated in FIG. 9 and actively cooled. Alternatively, the heat sinks may be external to the chamber 259 and may be passively cooled by convection. Further, if desired, any of the substrates or the heat sinks herein described may be cooled by a thermoelectric device (TED).

Figure 10:
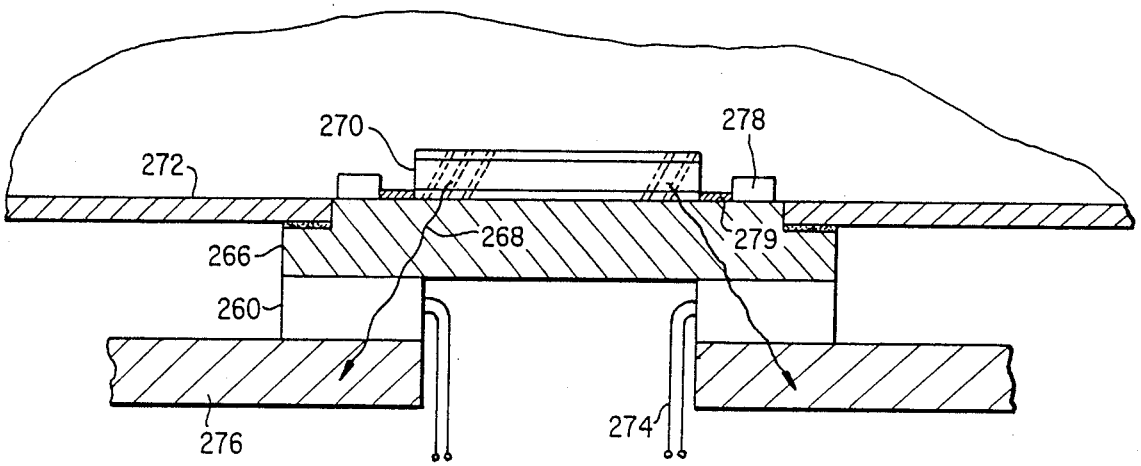
FIG. 10 illustrates another embodiment of a conductively cooled MCP according to the present invention employing a thermoelectric cooling device.

For example, in FIG. 10, one or more TED's 260 secured to the substrate 266 provides a mechanism for transferring heat 268 from the MCP 270 externally of the evacuated enclosure 272. The power supplied to terminals 274 of the TED 260 drives the TED 260 to move the heat 268 in the direction shown. An auxiliary heat exchanger 276 may be provided to relieve the TED 260 of its heat load. If desired, in high frequency applications one or more preamplifiers 278 may be directly formed or mounted on the substrate 266 and coupled to the MCP 270 by a stripline 279 or the like as shown.

Figure 11:
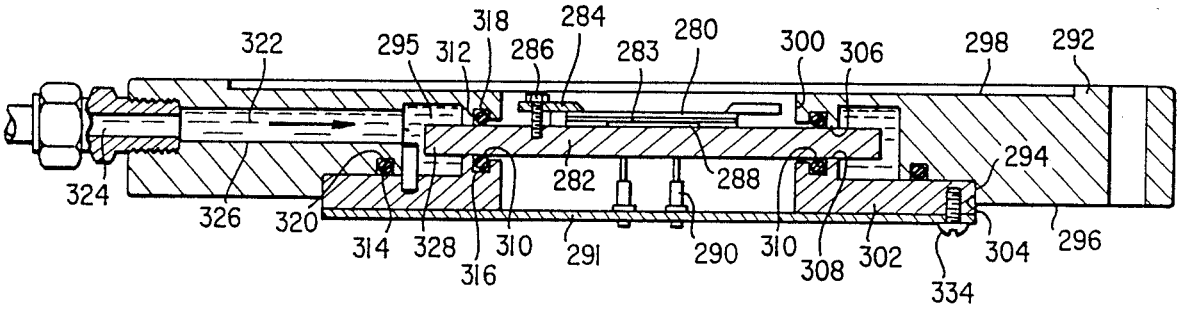
FIGS. 11 and 12 illustrates respective side sectional and top plan views of an embodiment of a conductively cooled microchannel plate according to the present invention which was fabricated under the above-mentioned government contract and which illustrates active cooling of the substrate.
Figure 12:
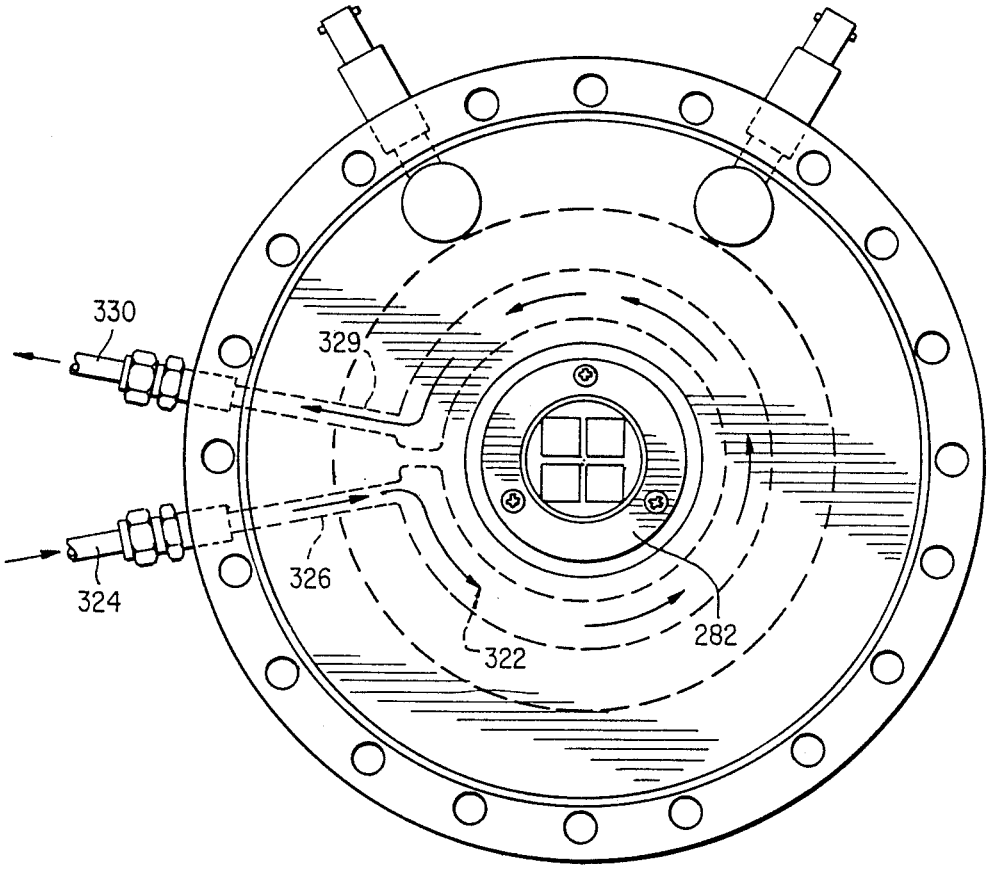

FIGS. 11 and 12 represent respective side sectional and top plan views of an embodiment of the invention including active cooling. In the arrangement, MCP 280 is bonded to substrate 282 by bonding layer 283. A biasing flange 284 carries bias voltage and is secured to the edge of the MCP 280 and to the substrate 282 by means of mounting hardware 286. The anode 288 which may form part of the bonding layer 283 is in direct contact with the MCP 280 and the substrate 282. Anode leads 290 are provided to connect the substrate 282 to a circuit card 291 which forms a ground plane for the MCP 280.

The MCP 280 and the substrate 282 are secured in a fluid (water) cooled support flange 292 which has an opened stepped recess 294 in the backside 296, a portion of which receives and supports the substrate 282 and the MCP 280 mounted thereon. The front side 298 of the support 292 has an opening 300 into which the MCP 282 is located. Substrate holddown 302 is located in the outer stepped portion 304 of the recess 294.

The peripheral edge portion 328 of the substrate 282 is captured between respective confronting annular faces 306 and 308 of the support 292 and the holddown 302 in an inner annular chamber 295 formed in the support flange 292. 0-rings 310, 312 and 314 in corresponding annular recesses 316, 318 and 320 seal the chamber 295 in the inner step portion of the recess 294 as shown.

Cooling fluid 322 communicates into the chamber 295 via radial inlet 324 and internal passage 326 in the support 292. The cooling fluid 322 fills the chamber 295 and circulates therein to cool the peripheral edge portion 328 of the substrate 282. A radial passage 329 and outlet 330 (FIG. 12), separated from the inlet passage 326 by the radial web portion 332 is provided to remove cooling fluid from the chamber 295. The web 332 prevents the short circuiting of circulation of cooling fluid 322 directly from the inlet 324 to the outlet 330 without first moving around the periphery 328 of the substrate 282. Screws 334 secure the holddown 302 to the support 292. The apparatus illustrated in FIGS. 11 and 12 is designed to be located in an evacuated chamber (not shown) and cooling fluid 322 is carried into and out of the chamber to actively cool the MCP 280. The arrangement of FIG. 11 is an embodiment of the invention which was manufactured under the above-noted government contract.

In accordance with the invention, the various substrates hereinbefore described may be formed of a variety of materials including, but not limited to conductive metals as well as various ceramics, oxides, nitrides, and glass.

The Table which follows illustrates the results obtained when an MCP having an initial resistance of 109.6 kilohms at 22° C. was mounted on a copper substrate by means of an indium solder bonding layer.

TABLE

| $V_{mcp}$ | $I_s$ | P ($= I_s V_{mcp}$) | $R_{mcp}$ ($= V_{mcp}/I_s$) |
|---|---|---|---|
| 0 volt | 0 μA | 0 watt | — kohms |
| 100 | 941 | .09 | 106.3 |
| 200 | 1898 | .38 | 105.4 |
| 300 | 2880 | .86 | 104.2 |
| 400 | 3898 | 1.56 | 102.6 |
| 500 | 4950 | 2.47 | 101.0 |
| 600 | 6060 | 3.64 | 99.0 |
| 700 | 7220 | 5.05 | 96.9 |
| 800 | 8510 | 6.81 | 94.0 |
| 900 | 9750 | 8.77 | 92.3 |
| 1000 | 11500 | 11.50 | 86.9 |
| 1070 | 13700 | 14.66 | 78.1 |
| 1070+ | unstable | — | — |

Initial MCP resistance:

$R_{mcp}$ (V=O)=109.6 kohm

Temp. coeff. of resistance: α

$R_{mcp}$(T=22° C.)=109.6 kohm $R_{mcp}$(T=30° C.)=99.4 kohm $R_{mcp}$ ($T$ = 22° C.) = 109.6 kohm $R_{mcp}$ ($T$ = 30° C.) = 99.4 kohm $$\alpha = \frac{R(t)/R_0 - 1}{\Delta t} = -1.1\%/°C.$$

Substrate:
Nickle-plated copper/disk 1" Thick ×4" diameter (Approximate weight 10 lbs)
Bonding layer:
100–200 microns-indium solder
MCP Dimensions
L/D=40
Channel Diameter (μm)=10
Channel Pitch (μm)=12
Bias (degrees)=11
Nominal OD (mm)=33
Active Diameter (mm)=25
Max Power Dissipated/cm$^2$ Active Area
14.66 W/4.9cm$^2$
2.99 W/cm$^2$ The table shows the $V_{mcp}$ or bias voltage in the extreme left-hand column. The next column lists the strip or bias current $I_s$ in microamps. The third column tabulates the power P dissipated by the conductively cooled MCP of the present invention. Note, for example, for the bias voltage $V_{mcp}$ of 1070 volts, the power dissipated is 14.66 watts. The fourth column shows the change in the resistance as the temperature of the MCP increases. It can be realized from an inspection of the table that a conductively cooled MCP, having an L/D of 40 and being fabricated in accordance with the present invention, can dissipate power levels almost 30 times greater than has hereinbefore been achieved by the prior art devices.

As is known in the art, MCPs may be operated in either analog or pulse counting modes. In the analog mode, electrical charge is collected by the anode and delivered to an electrometer (not shown) for measuring output current. In the pulse counting mode, electrical charge is collected by the anode and delivered to a charge sensitive or voltage sensitive preamplifier (not shown). In the latter cases, it is important that additional parasitic capacitance in the anode circuit be minimized to preserve the pulse amplitude. It can be seen from an inspection of the various embodiments of the present invention that there are relatively large electrically conductive surfaces such as the various biasing electrodes, the various anodes, and bonding layers, and there are also various dielectric layers sometimes in spaced relationship with the conductive layers. Accordingly, such MCP configurations have an inherent parasitic capacitance associated therewith. It should be understood that in order to provide for advantageous signal output, the various layers constituting the bias electrodes, the bonding layer, the substrate and the like should be configured to minimize parasitic capacitance as much as possible.

Another advantage of the present invention is that it eliminates susceptibility of the positional readout to image displacement caused by external magnetic fields. For example, in conventional readout configurations in which the anode is spaced from the MCP by gap 62 (FIG. 2), the physical separation between the anode and MCP results in a drift region therebetween. Accordingly, the charge cloud 52 can be influenced by the action of an external magnetic field, such as the earth's magnetic field. Thus, any change in detector orientation even in a weak magnetic field can introduce an image shift at the anode plane unless provision is made for magnetic shielding. However, such an image shift cannot occur when the drift region is eliminated, as in the case of the present invention where the anode is in direct contact with the output face of the MCP. Further, in non-uniform magnetic fields not only can image shift occur, but distortion of the image may be introduced if the magnetic field affects the charge in the drift region in a non-uniform manner.

While the invention has been described in connection with specific embodiments thereof, it will be understood that it is capable of further modifications. This application is intended to cover any variations, uses or adaptations of the invention following, in general, the principles of the invention, and including such departures from the present disclosure as come within known and customary practice within the art to which the invention pertains.

What is claimed is:

1. An electron multiplier device comprising; a microchannel plate (MCP) having active faces, and a thermally conductive substrate in intimate thermal contact with a portion of at least one of the active faces where electron multiplication occurs for dissipating joule heating produced in said MCP.

2. The device of claim 1 further comprising a bonding layer for securing the MCP to the substrate.

3. The device of claim 2 wherein the bonding layer includes a metal layer between the MCP and the substrate.

4. The device of claim 2 wherein the bonding layer includes an electrically insulating perforated layer between the MCP and the substrate.

5. The device of claim 2 wherein the bonding layer includes an indium-based solder about 100–200 microns thick.

6. The device of claim 2 wherein the bonding layer includes an apertured layer of sputtered glass.

7. The device of claim 2 further including a metal anode in direct contact with the bonding layer.

8. The device of claim 7 wherein the anode comprises a plurality of distinct electrically conductive areas which are electrically isolated from one another.

9. The device of claim 8 wherein the anode is a two dimensional array.

10. The device of claim 1 wherein the substrate is a block of thermally conductive material selected from the group consisting of metals, oxides, nitrides, ceramics and glass.

11. The device of claim 1 wherein the substrate is a thermally conductive grid having apertures therein attached to the input face of the MCP for allowing input radiation and particles to pass through the apertures to the active face of the MCP to which the grid is attached.

12. The device of claim 11 wherein the substrate is attached to the input face of the MCP for allowing input radiation and particles to pass through the apertures to the active face of the MCP to which the grid is attached.

13. The device of claim 12 further including an anode in spaced relation with the output face of the MCP.

14. The device of claim 1 further comprising a heat sink coupled to the substrate for carrying thermal energy away from the MCP via said substrate.

15. The device of claim 14 wherein the heat sink is coupled to a peripheral edge of the substrate.

16. The device of claim 14 wherein the heat sink is actively cooled.

17. The device of claim 14 wherein the heat sink is passively cooled.

18. The device of claim 1 further including means for actively cooling the substrate.

19. The device of claim 1 further including means for actively cooling internal portions of the substrate including at least one channel for receiving therein a cooling fluid passing in heat exchange relationship therethrough.

20. The device of claim 1 further including means for actively cooling the substrate comprising a thermoelectric device in heat exchange relationship therewith.

21. The device of claim 1 wherein the substrate is passively cooled.

22. The device of claim 1 wherein the substrate is in overlying relationship with microchannels in said MCP.

23. The device of claim 1 wherein the joule heat dissipated exceeds 0.1 watts/cm$^2$.

24. The device of claim 1 wherein joule heating is dissipated conductively.

25. The device of claim 1 wherein the active faces of the MCP are on opposite sides of the device.

26. The device of claim 1 further comprising an anode collector between the MCP and the substrate.

27. The device of claim 1 wherein the MCP is mountable within an evacuated chamber further comprising means for transporting heat away from the substrate.

28. The device of claim 27 wherein the means for transporting heat includes a fluid pipe for carrying a working fluid in heat exchange with the substrate.

29. The device of claim 27 wherein the means for transporting heat includes a heat sink in heat exchange relation with ambient atmosphere.

30. The device of claim 27 wherein the means for transporting heat further includes means for carrying the heat external of the chamber.

31. The device of claim 1 further comprising active circuit means on the substrate coupled to the MCP.

32. The device of claim 1 wherein the substrate comprises an electron responsive means.

33. The device of claim 32 wherein the electron responsive means comprises a metal anode.

34. The device of claim 33 wherein the anode is directly bonded to the MCP.

35. The device of claim 33 wherein the anode comprises a plurality of distinct electrically isolated conductive areas which are electrically isolated from one another.

36. The device of claim 35 wherein the anode is a two-dimensional array.

37. A method of operating a microchannel plate having active faces comprising the step of conductively cooling the MCP by intimately contacting a portion of the active face where electron multiplication occurs with a thermally conductive substrate for dissipating joule heating produced in said MCP.

38. The method of claim 37 further comprising the step of utilizing the substrate as an anode.

* * * * *